US007946808B2

(12) United States Patent
Taylor et al.

(10) Patent No.: US 7,946,808 B2
(45) Date of Patent: May 24, 2011

(54) SEAL BETWEEN ROTOR BLADE PLATFORMS AND STATOR VANE PLATFORMS, A ROTOR BLADE AND A STATOR VANE

(75) Inventors: Mark D Taylor, Derby (GB); John R Webster, Derby (GB)

(73) Assignee: Rolls-Royce plc, London (GB)

( * ) Notice: Subject to any disclaimer, the term of this patent is extended or adjusted under 35 U.S.C. 154(b) by 1049 days.

(21) Appl. No.: 11/785,323

(22) Filed: Apr. 17, 2007

(65) Prior Publication Data

US 2007/0243061 A1 Oct. 18, 2007

(30) Foreign Application Priority Data

Apr. 18, 2006 (GB) ..... 0607560.0

(51) Int. Cl.
*F01D 5/00* (2006.01)

(52) U.S. Cl. ..... 415/173.7; 416/193 A; 416/241 R

(58) Field of Classification Search ..... 415/115, 415/191, 211.2, 199.5, 173.7; 416/193 A, 416/241 R See application file for complete search history.

(56) References Cited

U.S. PATENT DOCUMENTS

| | | | | |
|---|---|---|---|---|
| 2,970,808 | A * | 2/1961 | Coppa | 416/190 |
| 3,982,850 | A * | 9/1976 | Jenkinson | 415/178 |
| 5,333,993 | A * | 8/1994 | Stueber et al. | 415/174.5 |
| 2005/0058539 | A1 * | 3/2005 | Diakunchak | 415/173.1 |
| 2008/0267770 | A1 * | 10/2008 | Webster et al. | 415/173.1 |

FOREIGN PATENT DOCUMENTS

| | | |
|---|---|---|
| FR | 2 715 968 | 8/1995 |

* cited by examiner

*Primary Examiner* — Edward Look
*Assistant Examiner* — Aaron R Eastman
(74) *Attorney, Agent, or Firm* — Jeffrey S. Melcher; Manelli Denison & Selter PLLC

(57) ABSTRACT

A rotor and a stator assembly, wherein the rotor (30) comprises at least one stage of rotor blades (32) and the stator (34) comprises at least one stage of turbine stator vanes (36). The rotor blades (32) have aerofoils and platforms (42) and the turbine stator vanes (36) having aerofoils and platforms (48). A seal (43,45) is defined between the rotor blade (32) platforms (42) and the stator vane (36) platforms (48) wherein a portion (42B) of the rotor blade platforms (42) and/or a portion (48B) of the stator vane (36) platforms (48) comprise a shape memory alloy member or a bimetallic member. The shape memory alloy member, or bimetallic member, controls the flow of cooling air through the seals (43,45) allowing a greater cooling flow at higher temperatures than at lower temperatures.

15 Claims, 2 Drawing Sheets

SEAL BETWEEN ROTOR BLADE PLATFORMS AND STATOR VANE PLATFORMS, A ROTOR BLADE AND A STATOR VANE

CROSS-REFERENCE TO RELATED APPLICATIONS

This application claims priority to GB 0607560.0, 18 Apr. 2006.

BACKGROUND OF THE INVENTION

The present invention relates to a seal between rotor blade platforms and stator vane platforms, and in particular to a seal between turbine rotor blade platforms and turbine stator vane platforms of a turbomachine, for example a gas turbine engine.

A turbine of a gas turbine engine comprises one or more stages of turbine rotor blades arranged alternately with one or more stages of turbine stator vanes. Each of the turbine rotor blades comprises a root, a shank, a platform and an aerofoil. The turbine rotor blades are arranged circumferentially around a turbine rotor and the turbine rotor blades extend generally radially from the turbine rotor. The roots of the turbine rotor blades are located in axially, or circumferentially, extending slots in the periphery of a turbine rotor. The platforms of the turbine rotor blades together define the inner boundary of a portion of the flow path through the turbine. In some instances the turbine rotor blades may have shrouds at their radially outer ends to define a portion of the outer boundary of the flow path through the turbine. The turbine stator vanes also have platforms at their radially inner ends and shrouds at their radially outer ends.

Generally, the platforms of the turbine rotor blades and the platforms of the turbine stator vanes have upstream and downstream portions, which extend axially towards each other. Thus the turbine rotor blades in a stage of turbine rotor blades have upstream portions of the platforms, which extend in an upstream direction towards a downstream portion of the platform of the stage of turbine stator vanes immediately upstream of the stage of turbine rotor blades. The stage of turbine stator vanes immediately upstream of the stage of turbine rotor blades has a downstream portion of the platform, which extends in a downstream direction towards the upstream portion of the platforms of the turbine rotor blades and the downstream portion of the platform of the turbine stator vanes is arranged radially around the upstream portions of the platforms of the turbine rotor blades.

Similarly the turbine rotor blades in the stage of turbine rotor blades have downstream portions of the platforms, which extend in a downstream direction towards an upstream portion of the platform of the stage of turbine stator vanes immediately downstream of a stage of turbine rotor blades. The stage of turbine stator vanes immediately downstream of the stage of turbine rotor blades has an upstream portion of the platform, which extends in an upstream direction towards the downstream portions of the platforms of the turbine rotor blades and the downstream portions of the platforms of the turbine rotor blades are arranged radially around the upstream portion of the platform of the turbine stator vanes.

A clearance is formed between the upstream portions of the platforms of the stage of turbine rotor blades and the downstream portion of the platform of the upstream stage of turbine stator vanes and a clearance is formed between the downstream portions of the platforms of the stage of turbine rotor blades and the upstream portion of the platform of the downstream stage of turbine stator vanes.

These clearances control the amount of cooling air flowing from within the interior of the turbine into the flow path through the turbine and control the flow of hot gases from the turbine flow path into the interior of the turbine. The platforms of the turbine rotor blades and turbine stator vanes overlap to provide a smooth flow line for the inner boundary of the flow path through the turbine.

A problem with this arrangement is that these clearances change with temperature, speed of rotation of the turbine rotor etc. The clearances increase in dimension at some operating conditions. This increase in clearances leads to excessive cooling flow through the clearances and hence a loss of efficiency of the turbine and the gas turbine engine. Additionally there is a change in the clearances, and their effectiveness, due to wear of the platforms and/or relative movement between the turbine rotor and turbine stator.

SUMMARY OF THE INVENTION

Accordingly the present invention seeks to provide a novel seal between a rotor blade platform and a stator vane platform, which reduces, preferably overcomes, the above-mentioned problem.

Accordingly the present invention provides a rotor and a stator assembly, the rotor comprising at least one stage of rotor blades and the stator comprising at least one stage of stator vanes, the rotor blades having platforms and the stator vanes having platforms, a seal being defined between the rotor blade platforms and the stator vane platforms wherein a portion of the rotor blade platforms and/or a portion of the stator vane platforms comprise a shape memory alloy member or a bimetallic member.

Preferably the rotor blades are turbine rotor blades and the turbine stator vanes are turbine stator vanes.

The portion of the rotor blade platforms and/or the portion of the stator vane platforms may be arranged at the downstream end of the rotor blade platforms and/or at the downstream ends of the stator vane platforms.

The bimetallic member may comprise a first metal having a high thermal coefficient of expansion and a second metal having a low thermal coefficient of expansion and the second metal having the low thermal coefficient of expansion is arranged nearer the aerofoils than the first metal having the higher thermal coefficient of expansion.

The present invention also provides a rotor blade comprising a root portion, a shank portion, a platform portion and an aerofoil portion, wherein at least a portion of the platform portion comprises a shape memory alloy member or a bimetallic member.

The rotor blade may be a turbine rotor blade.

The portion of the rotor blade platform may be arranged at the downstream end of the rotor blade platform.

The bimetallic member may comprise a first metal having a high thermal coefficient of expansion and a second metal having a low thermal coefficient of expansion and the second metal having the low thermal coefficient of expansion is arranged nearer the aerofoil than the first metal having the higher thermal coefficient of expansion.

The present invention also provides a stator vane comprising a platform portion and an aerofoil portion, wherein at least a portion of the platform portion comprises a shape memory alloy member or a bimetallic member.

The stator vane may be a turbine stator vane.

The portion of the stator vane platform may be arranged at the downstream end of the stator vane platform.

The bimetallic member may comprise a first metal having a high thermal coefficient of expansion and a second metal having a low thermal coefficient of expansion and the second metal having the low thermal coefficient of expansion is arranged nearer the aerofoils than the first metal having the higher thermal coefficient of expansion.

BREIF DESCRIPTION OF THE DRAWINGS

The present invention will be more fully described by way of example with reference to the accompanying drawings in which.

DETAILED DESCIPTION OF THE INVENTION

Figure 1:
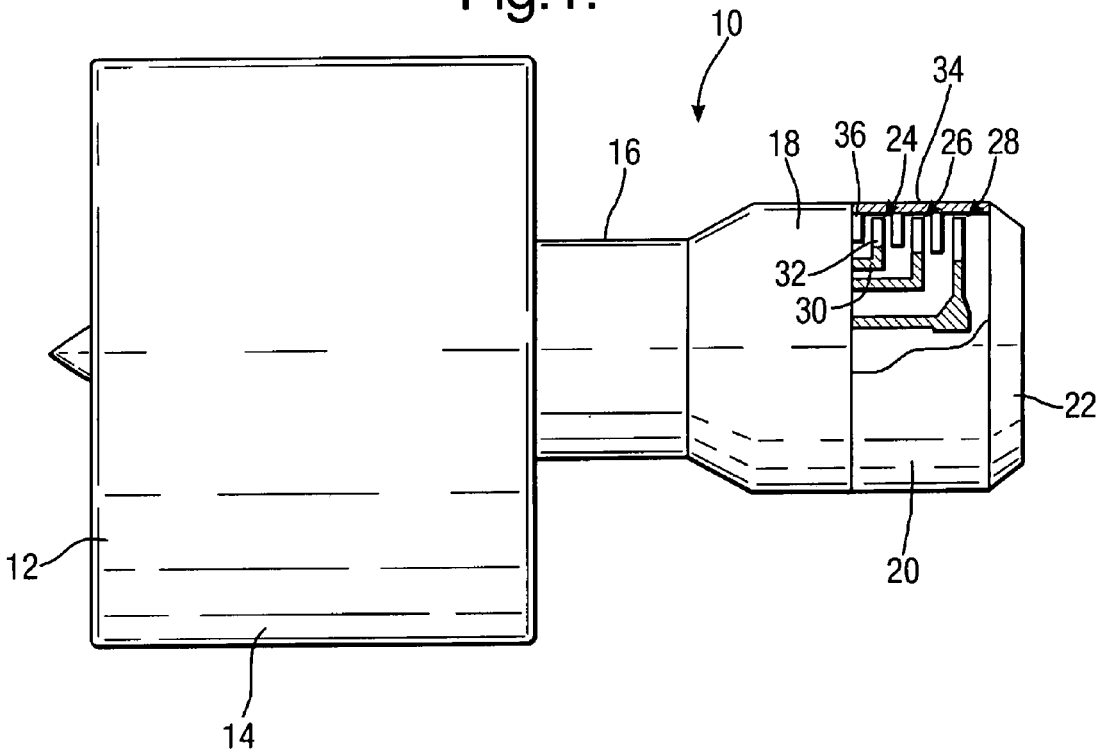
FIG. 1 shows a turbofan gas turbine engine having a seal between a rotor blade platform and a stator vane platform according to the present invention.

A turbofan gas turbine engine 10, as shown in FIG. 1, comprises in axial flow series an intake 12, a fan section 14, a compressor section 16, a combustion section 18, a turbine section 20 and a core exhaust 22. The turbine section 20 comprises a high pressure turbine 24 arranged to drive a high pressure compressor (not shown) in the compressor section 16, an intermediate pressure turbine 26 arranged to drive an intermediate pressure compressor (not shown) in the compressor section 16 and a low pressure turbine 28 arranged to drive a fan (not shown) in the fan section 14.

Figure 2:
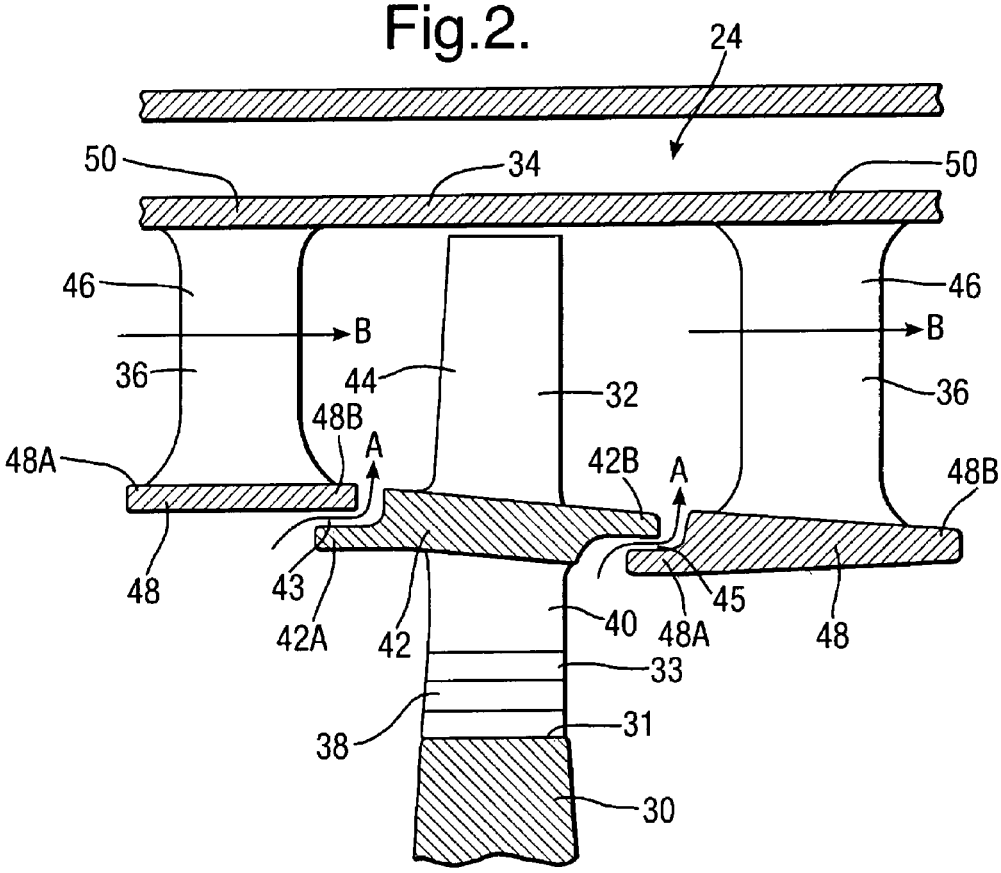
FIG. 2 shows an enlarged view of a seal between a rotor blade platform and a stator vane platform according to the present invention.
Figure 3:
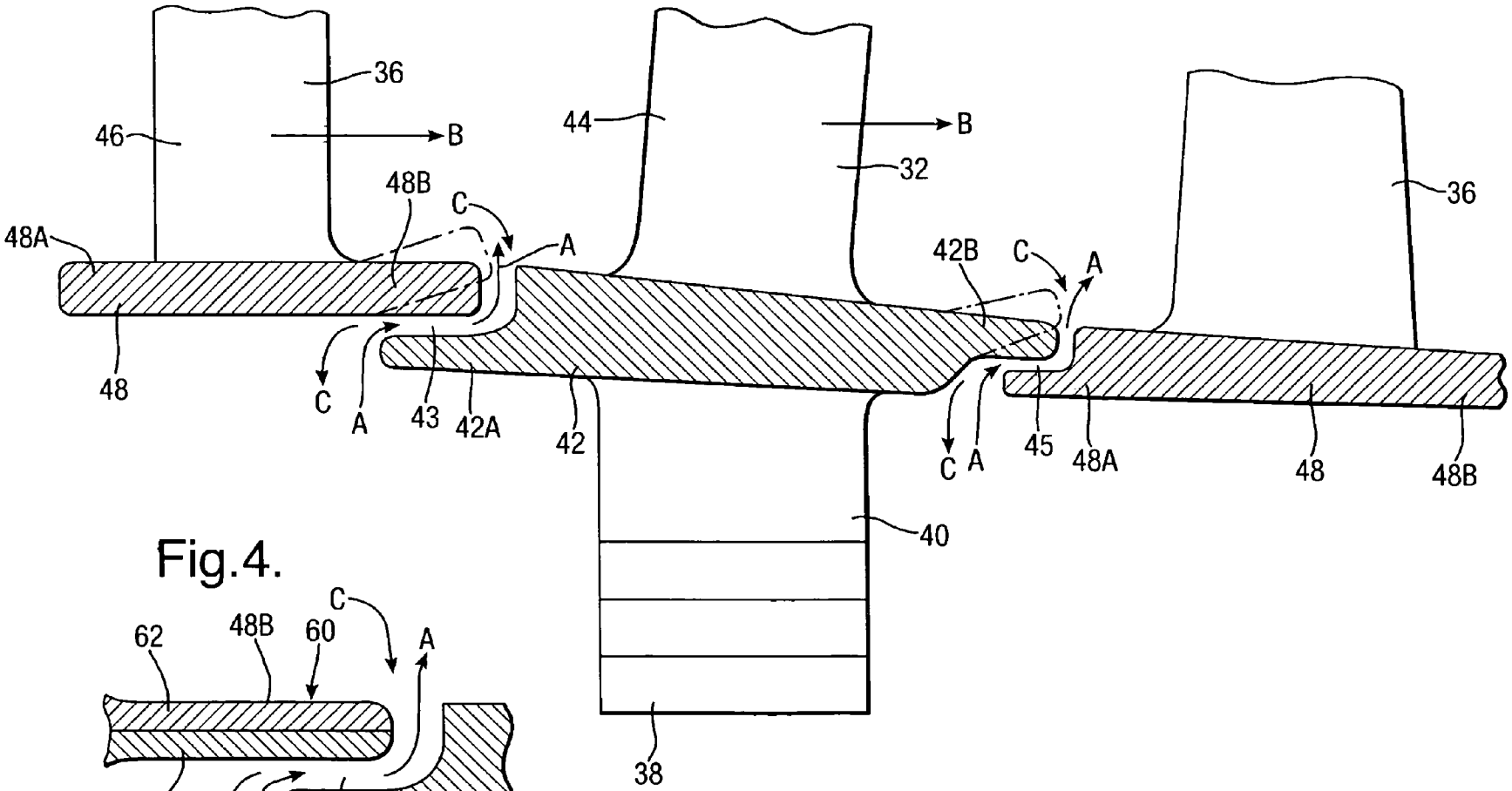
FIG. 3 shows a further enlarged view of a seal between a rotor blade platform and a stator vane platform according to the present invention.
Figure 4:
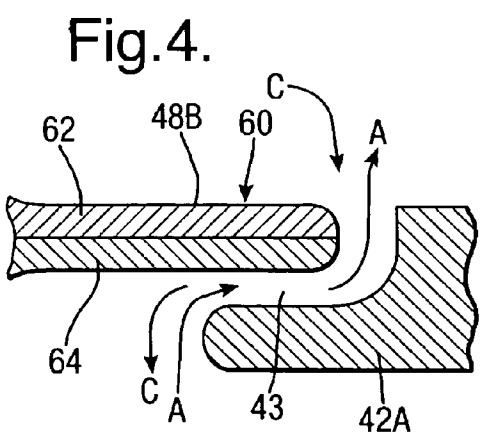
FIG. 4 shows an enlarged cross-sectional view of a platform according to the present invention.

The high-pressure turbine 24 of the gas turbine engine 10 is shown more clearly in FIGS. 2 to 4. The high-pressure turbine 24 comprises one or more stages of turbine rotor blades 32 arranged alternately with one or more stages of turbine stator vanes 36. Each of the turbine rotor blades 32 comprises a root 38, a shank 40, a platform 42 and an aerofoil 44. The turbine rotor blades 32 are arranged circumferentially around a turbine rotor 30 and the turbine rotor blades 32 extend generally radially from the turbine rotor 30. The roots 38 of the turbine rotor blades 32 are located in axially, or circumferentially, extending slots 31 in the periphery 33 of the turbine rotor 30. The platforms 42 of the turbine rotor blades 32 together define the inner boundary of a portion of the flow path through the high-pressure turbine 24. The turbine stator vanes 36 also comprise aerofoils 46, which have platforms 48 at their radially inner ends and shrouds 50 at their radially outer ends. The turbine stator vanes 36 are secured to a stator 34, e.g. casing.

The platforms 42 of the turbine rotor blades 32 and the platforms 48 of the turbine stator vanes 36 have upstream and downstream portions 42A, 42B, 48A and 48B, which extend axially towards each other. Thus the turbine rotor blades 32 in a stage of turbine rotor blades 32 have upstream portions 42A of the platforms 42, which extend in an upstream direction towards the downstream portions 48B of the platforms 48 of the stage of turbine stator vanes 36 immediately upstream of the stage of turbine rotor blades 32. The stage of turbine stator vanes 36 immediately upstream of the stage of turbine rotor blades 32 has downstream portions 48B of the platforms 48, which extends in a downstream direction towards the upstream portions 42A of the platforms 42 of the turbine rotor blades 32 and the downstream portions 48B of the platforms 48 of the turbine stator vanes 36 are arranged radially around the upstream portions 42A of the platforms 42 of the turbine rotor blades 32.

Similarly the turbine rotor blades 32 in the stage of turbine rotor blades 32 have downstream portions 42B of the platforms 42, which extend in a downstream direction towards upstream portions 48A of the platforms 48 of the stage of turbine stator vanes 36 immediately downstream of a stage of turbine rotor blades 32. The stage of turbine stator vanes 36 immediately downstream of the stage of turbine rotor blades 32 has upstream portions 48A of the platforms 48, which extend in an upstream direction towards the downstream portions 42B of the platforms 42 of the turbine rotor blades 32 and the downstream portions 42B of the platforms 42 of the turbine rotor blades 32 are arranged radially around the upstream portions 48A of the platforms 48 of the turbine stator vanes 36.

A clearance, or seal, 43 is formed between the upstream portions 42A of the platforms 42 of the stage of turbine rotor blades 32 and the downstream portions 48B of the platforms 48 of the upstream stage of turbine stator vanes 36 and a clearance, or seal, 45 is formed between the downstream portions 42B of the platforms 42 of the stage of turbine rotor blades 32 and the upstream portions 48A of the platforms 48 of the downstream stage of turbine stator vanes 36.

These clearances, or seals, 43 and 45 control the amount of cooling air A flowing from within the interior of the high-pressure turbine 24 into the flow path B through the turbine 24 and control the flow of hot gases C from the turbine flow path into the interior of the high-pressure turbine 24. The platforms 42, 48 of the turbine rotor blades 32 and turbine stator vanes 36 overlap to provide a smooth flow line for the inner boundary of the flow path through the high-pressure turbine 24.

The downstream portions 48B of the platforms 48 of the turbine stator vanes 36 of the upstream stage of turbine stator vanes 36 comprises a shape memory alloy member or a bimetallic member. The downstream portions 42B of the platforms 42 of the turbine rotor blades 32 comprises a shape memory alloy member or a bimetallic member.

The shape memory alloy members, or the bimetallic members, of the downstream portions 42B and 48B of the platforms 42 and 48 of the turbine rotor blades 32 and turbine stator vanes 36 respectively are arranged such that above a predetermined temperature, for example in the range 800° C. to 1000° C. the shape memory alloy members or bimetallic members change shape, bend radially outwardly, to increase the clearances 45 and 43 respectively in order to allow a greater flow of cooling air A through the clearances 45 and 43 into the flow path B through the high-pressure turbine 24, as shown by the dashed lines in FIG. 3.

The shape memory alloy members, or the bimetallic members, of the downstream portions 42B and 48B of the platforms 42 and 48 of the turbine rotor blades 32 and turbine stator vanes 36 respectively are arranged such that below the predetermined temperature, for example in the range 800° C. to 1000° C. the shape memory alloy members or bimetallic members change shape, bend radially inwardly, back to their original positions to decrease the clearances 45 and 43 respectively in order to allow a lesser flow of cooling air A through the clearances 45 and 43 into the flow path B through the high-pressure turbine 24 and to prevent the flow C of hot gases from the flow path B to the interior of the high-pressure turbine 24 as shown by the full lines in FIG. 3.

There are many metals and/or alloys, which have non-linear thermal coefficients of expansion in this temperature region. A bimetallic member would use metals and/or alloys chosen to give a large mismatch in thermal coefficients of expansion in this temperature range to give maximum movement of the bimetallic member, but a small mismatch in thermal coefficients of expansion at temperatures lower than this temperature range to minimise movements and reduce the possibility of contact between the radially adjacent portions of the platforms. Thus the bimetallic member 60 comprises two metals/alloy members 62, 64 with different thermal coefficients of expansion. The metal member 62 with the lower thermal coefficient of expansion is arranged radially further from the axis of the high-pressure turbine 24, radially nearer the flow path B through the high-pressure turbine 24, than the metal member 64 with the higher thermal coefficient of expansion as shown in FIG. 4.

The shape memory alloy member for example may comprise a nickel-titanium-palladium shape memory alloy, an iron-nickel-cobalt-titanium shape memory alloy, an iron-manganese-silicon shape memory alloy or an iron-manganese-carbon shape memory alloy.

The shape memory alloy member may be pre-stressed. The shape memory alloy members or bimetallic members of the portions 42B and 48B of the platforms 42 and 48 of the turbine rotor blades 32 and turbine stator vanes 36 may be continuous annular members or part annular members.

In some instances the turbine rotor blades 32 may have shrouds at their radially outer ends to define a portion of the outer boundary of the flow path through the high turbine.

Although the present invention has been described with reference to a high-pressure turbine it may also be used in an intermediate pressure turbine or a low-pressure turbine. Although the present invention has been described with reference to turbine blades and turbine vanes, it may be applicable to compressor blades and compressor vanes.

We claim:

1. A rotor and a stator assembly, the rotor comprising at least one stage of rotor blades and the stator comprising at least one stage of stator vanes, the rotor blades having aerofoils and platforms, the rotor blade platforms being arranged at the radially inner ends of the rotor blade aerofoils, the stator vanes having aerofoils and platforms, the stator vane platforms being arranged at the radially inner ends of the stator vane aerofoils, wherein a seal having a clearance is defined between the rotor blade platforms and the stator vane platforms, and wherein a portion of the rotor blade platforms and/or a portion of the stator vane platforms are arranged such that below a predetermined temperature the portion of the rotor blade platforms and/or a portion of the stator vane platforms have an original position to decrease the clearance of the seal and such that above the predetermined temperature the portion of the rotor blade platforms and/or the portion of the stator vane platforms changes shape to increase the clearance of the seal, and such that when the temperature moves from above the predetermined temperature to below the predetermined temperature the portion of the rotor blade platforms and/or the portions of the stator vane platforms change shape to decrease the clearance of the seal, the portion of the rotor blade platforms and/or the portion of the stator vane platforms being arranged at the downstream end of the rotor blade platforms and/or at the downstream end of the stator vane platforms, and wherein the portion of the rotor blade platforms and/or the portion of the stator vane platforms comprises a bimetallic member.

2. A rotor and stator assembly as claimed in claim 1 wherein the rotor blades are turbine rotor blades and the stator vanes are turbine stator vanes.

3. A rotor and stator assembly as claimed in claim 1 wherein the rotor blade platforms have upstream portions and downstream portions and the stator vane platforms have upstream portions and downstream portions.

4. A rotor and stator assembly as claimed in claim 3 wherein the downstream portions of the rotor blade platforms extend in a downstream direction towards the stator vane platforms, the upstream portions of the stator vane platforms extend in an upstream direction towards the rotor blade platforms, the downstream portions of the rotor blade platforms are arranged around the upstream portions of the stator vane platforms and the downstream portions of the rotor blade platforms are arranged to change shape to alter the clearance of the seal.

5. A rotor and stator assembly as claimed in claim 3 wherein the downstream portions of the stator vane platforms extend in a downstream direction towards the rotor blade platforms, the upstream portions of the rotor blade platforms extend in an upstream direction towards the stator vane platforms, the downstream portions of the stator vane platforms are arranged around the upstream portions of the rotor blade platforms and the downstream portions of the stator vane platforms are arranged to change shape to alter the clearance of the seal.

6. A rotor and stator assembly as claimed in claim 1 wherein the bimetallic member comprises a first metal having a high thermal coefficient of expansion and a second metal having a low thermal coefficient of expansion and the second metal having the low thermal coefficient of expansion is arranged nearer the aerofoils than the first metal having the higher thermal coefficient of expansion.

7. A rotor and stator assembly as claimed in claim 1 wherein each rotor blade comprises a root portion, a shank portion, a platform portion and an aerofoil portion, the platform portion is arranged between the shank portion and the aerofoil portion.

8. A gas turbine engine having a rotor and stator assembly as claimed in claim 1.

9. A rotor blade comprising:

a root portion;

a shank portion;

a platform portion; and an aerofoil portion, wherein the platform portion is arranged between the shank portion and the aerofoil portion, and wherein at least a portion of the platform portion is arranged to define a seal having a clearance such that below a predetermined temperature the portion of the platform portion has an original position to decrease the clearance of the seal and above the predetermined temperature the portion of the platform portion changes shape, to increase the clearance of the seal such that when the temperature moves from above the predetermined temperature to below the predetermined temperature the portion of the platform changes back to the original position, and wherein the portion of the platform portion is arranged at the downstream end of the platform portion, and wherein the portion of the platform portion is selected from the group comprising a shape memory alloy member and a bimetallic member.

10. A rotor blade as claimed in claim 9 wherein the rotor blade is a turbine rotor blade.

11. A rotor blade as claimed in claim 9 wherein the bimetallic member comprises a first metal having a high thermal coefficient of expansion and a second metal having a low thermal coefficient of expansion and the second metal having the low thermal coefficient of expansion is arranged nearer the aerofoil than the first metal having the higher thermal coefficient of expansion.

12. A stator vane comprising:

a platform portion; and an aerofoil portion, wherein the platform portion is arranged at the radially inner end of the aerofoil, and wherein at least a portion of the platform portion is arranged to define a seal having a clearance such that below a predetermined temperature the portion of the platform portion has an original position to decrease the clearance of the seal and above the predetermined temperature the portion of the platform portion changes shape to increase the clearance of the seal, such that when the temperature moves from above the predetermined temperature to below the predetermined temperature the portion of the platform changes back to the original position, and wherein the portion of the platform portion is arranged at the downstream end of the platform portion, and wherein the portion of the platform portion is selected from the group comprising a shape memory alloy member and a bimetallic member.

13. A stator vane as claimed in claim 12 wherein the stator vane is a turbine stator vane.

14. A stator vane as claimed in claim 12 wherein the bimetallic member comprises a first metal having a high thermal coefficient of expansion and a second metal having a low thermal coefficient of expansion and the second metal having the low thermal coefficient of expansion is arranged nearer the aerofoils than the first metal having the higher thermal coefficient of expansion.

15. A rotor and stator assembly comprising:

a rotor comprising at least one stage of rotor blades, said rotor blades having aerofoils and platforms, said rotor blade platforms being arranged at the radially inner ends of the rotor blade aerofoils;

a stator comprising at least one stage of stator vanes, said stator vanes having aerofoils and platforms, said stator vane platforms being arranged at the radially inner ends of the stator vane aerofoils; and a seal having a clearance being defined between said rotor blade platforms and said stator vane platforms, wherein a portion of said rotor blade platforms and/or a portion of said stator vane platforms are arranged such that below a predetermined temperature said portion of rotor blade platforms and/or said portion of said stator vane platforms have an original position to decrease the clearance of the seal and such that above the predetermined temperature said portion of the rotor blade platforms and/or said portion of said stator vane platforms changes shape to increase the clearance of the seal, and such that when the temperature moves from above the predetermined temperature to below the predetermined temperature the portion of the rotor blade platforms and/or the portions of the stator vane platforms change shape to decrease the clearance of the seal, said portion of said rotor blade platforms and/or said portion of said stator vane platforms being arranged at the downstream end of the rotor blade platforms and/or at the downstream end of the stator vane platforms, and wherein said portion of said rotor blade platforms and/or said portion of said stator vane platforms comprises a shape memory alloy member.

* * * * *